United States Patent [19]

Neufeldt

[11] 4,306,699

[45] Dec. 22, 1981

[54] SUSPENDED REFUSE CONTAINER

[76] Inventor: Jacob J. Neufeldt, c/o Neufeldt Industries, Inc., P.O. Box 597, Lethbridge, Alberta, Canada, T1J 3Z4

[21] Appl. No.: 45,667

[22] Filed: Jun. 5, 1979

[51] Int. Cl.[3] ..... A47F 5/12

[52] U.S. Cl. ..... 248/134; 211/82; 232/43.5

[58] Field of Search ..... 248/131, 134, 137, 145, 248/147, 141, 142, DIG. 7; 211/81, 82, 83, 84; 220/18; 232/43.5; 294/73

[56] References Cited

U.S. PATENT DOCUMENTS

| | | | |
|---|---|---|---|
| 256,100 | 4/1882 | Calkins et al. | 294/73 |
| 871,955 | 11/1907 | Reed | 220/18 |
| 1,083,878 | 1/1914 | Foley et al. | 294/73 |
| 1,485,496 | 3/1924 | Elliott | 220/18 UX |
| 1,584,085 | 5/1926 | England | 248/145 |
| 1,614,400 | 1/1927 | Selman et al. | 294/73 X |
| 1,997,520 | 4/1935 | Heath | 211/82 |
| 2,050,573 | 8/1936 | Kammerich | 248/145 |
| 2,303,067 | 11/1942 | Richard | 248/134 |
| 2,701,112 | 2/1955 | Powers | 248/134 |
| 3,527,356 | 9/1970 | Herdy | 211/82 |

FOREIGN PATENT DOCUMENTS

| | | | |
|---|---|---|---|
| 261998 | 11/1927 | Italy | 294/73 |

*Primary Examiner*—J. Franklin Foss

*Attorney, Agent, or Firm*—Larson and Taylor

[57] ABSTRACT

The specification describes a device for containing refuse, including a container having a refuse receiving and discharge opening, a cover overlying the opening and pivotally connected to the container, and means for supporting the container above ground level for free swinging movement in a stable, normally upright position. The container is pivotable relative to the support means about a generally horizontal axis extending through the container upon application to the container about the axis for discharging the container.

9 Claims, 6 Drawing Figures

SUSPENDED REFUSE CONTAINER

The present invention relates to an animal-proof and, particularly, bear-proof refuse containing device.

BACKGROUND OF THE INVENTION

Various types of animal-proof refuse containers have been proposed for use in parks, camp grounds and the like. Bears, wolves and deer are particularly powerful animals and normally have little difficulty in upsetting refuse containers and spreading the contents thereof throughout the camp grounds. It is obvious that such animals not only create a mess but also present a danger to campers and vacationers and, accordingly, it would be desirable to discourage their visits to camp grounds.

One attempt at overcoming the foregoing problem was to provide a small building having a door which can be locked and which contains refuse containers either of the conventional, metal can or plastic garbage bag type normally used for domestic use. While such a building is normally effective to keep scavenging animals away from the refuse, there are a number of drawbacks. Firstly, it is not economically feasible or aesthetically pleasing to provide as many buildings as are necessary to adequately service the camp grounds or parks. As a result, the buildings tend not to be used and the problem is not solved. Secondly, because the buildings have a relatively large capacity, they are generally not emptied as frequently as they should be and this results in an unpleasant odor in the vicinity of the building. This, in turn, renders the task of emptying the building rather unpleasant. Thirdly, again because of the large capacity, it is time consuming to manually empty the buildings. Fourthly, the buildings tend to attract vermin. Thus, this solution has a number of significant disadvantages.

Another attempt at overcoming this problem was to provide special enclosures for conventional domestic refuse cans. Generally, such enclosures tend to be in the form of concrete boxes which normally enclose two refuse cans and have one open side wall provided with a single removable steel bar. It has been found that bears have had no difficulty in removing the bar and thereby attaining access at the refuse containers. In addition, the containers and enclosures tend to be unsightly.

A still further attempt involves the use of commercial heavy steel refuse containers having a capacity of five or six cubic yards. These containers are emptied by conventional refuse collection vehicles having front end overloaders. It has been found that bears have had little difficulty in upsetting these containers. Furthermore, such containers require special refuse vehicles which do not operate efficiently in such an environment.

Still another solution to the aforementioned difficulty is the provision of a conventional refuse can fitted with a special cover reciprocably mounted on an upright post anchored into a concrete slab upon which the container sits. Such containers have low capacity, are inconvenient to empty and are not entirely animal-proof.

SUMMARY OF THE INVENTION

The present invention overcomes the above discussed problems and disadvantages of prior art devices by providing means for supporting a container for free omni-directional swinging movement in a stable, normally and substantially upright position. The container is provided with a cover which is pivoted to the side of the container, which overlies a refuse discharge opening formed in the upper end of the container and which is formed without means which can be grasped by a bear or other animal. Thus, animals soon become frustrated in their attempts to attain access to the interior of the container and quit. The container is pivotable relative to the supporting means, about a horizontal axis extending through the container, upon application of an appropriate couple to the container for discharging purposes. Thus, as it will become clearer in the description which follows, the present device is not only animal-proof but also simple to load and unload.

These and other features of the invention will become clearer from the description which follows in which reference is made to the appended drawings.

DETAILED DESCRIPTION OF THE DRAWINGS

Figure 1:
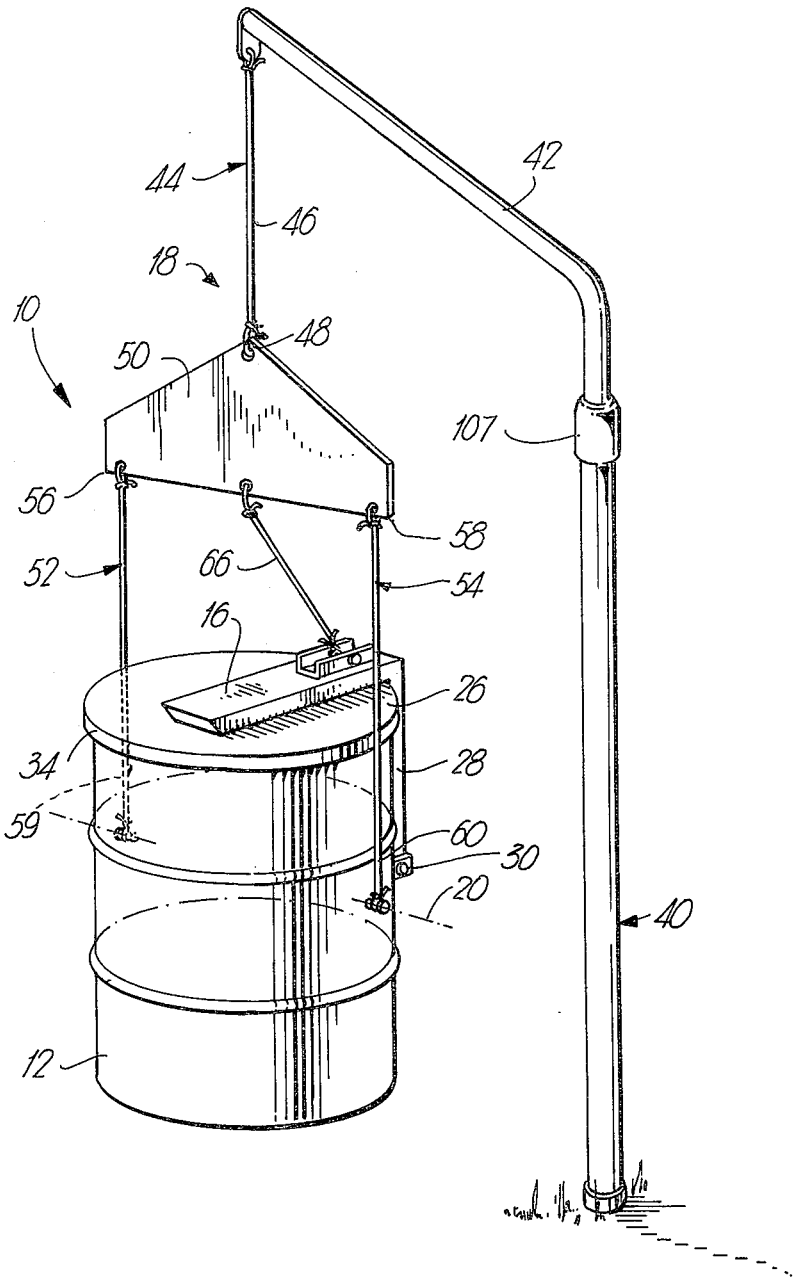
FIG. 1 is a perspective view of the refuse container of the present invention.

The device of the present invention is generally designated by reference numeral 10 and generally includes a container 12 having a refuse receiving and discharge opening 14 and a cover 16 overlying opening 14. The cover is pivotally connected to the container in a manner to be described later. A support means 18 is provided to suspend the container for free omni-directional movement in a stable, normally upright position. The container is pivotable relative to the support means about a generally horizontal axis 20 upon application of an appropriate torque or couple about the axis for emptying purposes.

The container is preferably cylindrical. It has been found that conventional cylindrical, 45-gallon drums are quite satisfactory for the purposes of the present invention. Such drums are free of protuberances or the like which would provide a gripping means for animals and are readily available. The drum includes an annular side wall 22, a circular bottom wall 24 and an open top defining opening 14.

Cover 16 is a unitary, plastic member having a disc-like portion 26 which abuttingly overlies opening 14 and an arm 28 which extends radially outwardly of disc portion 26 and then downwardly, toward bottom wall 24 parallel to the axis of the container and on the exterior of the container. Arm 28 is pivotally connected to the exterior side of the container at 30. While the cover need not be formed with a handle, an inwardly inclined grip 32 may be provided for the convenience of the users. In order to open the cover, the direction of the opening force is especially important and, particularly, must be applied in a vertical direction against edge 34 of the disc 26 or grip 32 if it is provided. It has been found that animals, particularly bears, have been unable to open the above described cover because they tend to apply a horizontal rather than vertical force.

As mentioned earlier, the container is supported above ground level for free omni-directional swinging movement. A natural tendency for animals is to attempt to destroy refuse containers in order to get at food scraps located inside. By suspending the containers, animals are unable to toss the container or crush it and, thus, quickly become frustrated. A satisfactory support means 18 is illustrated in the drawings.

The support means will typically include an elongated pole 40 adapted to be rigidly secured in a support surface which will normally be the ground. The upper end 42 of the pole is bent or curved to one side. A first cable 44 is suspended from end 42 and is secured at its lower end 46 to one apex 48 of a rigid triangular spreader member 50. A pair of cables 52 and 54 are suspended from the other two apices 56 and 58 of member 50. The lower ends 59 and 60 of cables 50 and 52 are secured to opposite sides of the container. Member 50 serves to space apart cables 52 and 54 a sufficient distance so as not to interfere with the pivotal movement of the container to be described later.

Cables 52 and 54 are secured to the container along a straight line which is substantially parallel to the pivot axis of the cover and which defines the pivot axis 20 about which the container is pivoted during the discharging procedure. Axis 20 is located above the centre of gravity of the container and on the opposite side thereof from the pivot axis of the cover. The reasons for this are twofold. The pivot axis is above the centre of gravity so that the container will remain in a stable, upright position even if a blow is applied by a bear or the like. On the other hand, the pivot axis should not be too far above the centre of gravity so that it becomes difficult to tip or pivot the container when discharging.

Figure 2:
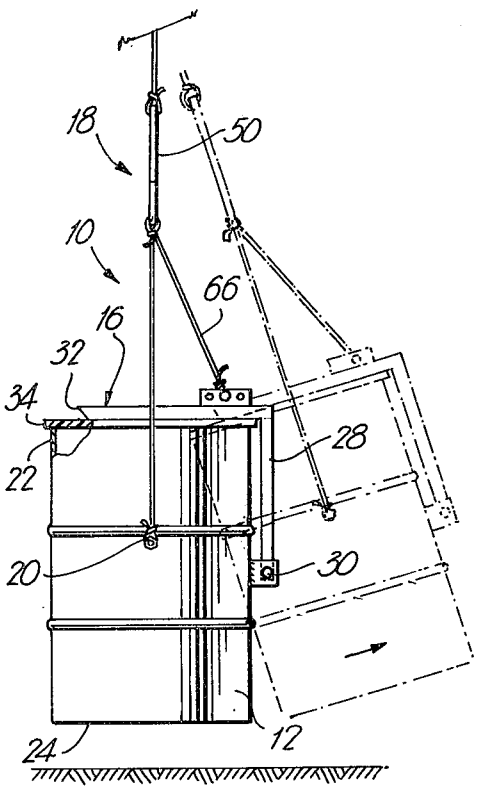
FIG. 2 is a partially broken side elevational view of the container of FIG. 1.

In practice, it is difficult to determine the precise location of the centre of gravity of the container and, adding to this difficulty, the centre of gravity will vary with the amount and type of refuse placed in the container. Thus, if the axis 20 is positioned directly above the theoretical centre of gravity of an empty container, the container will tend to assume an inclination on one side or the other of a vertical line extending through the centre of gravity thereof which, in turn, may make it easy for a wild animal to tip the container. To overcome this problem, the pivot axis is located on one side of the centre of gravity and additional means is provided to maintain the container in a normally upright position. Thus, as indicated earlier, the pivot axis 20 is positioned on the side of the centre of gravity opposite the cover pivot. The additional means is in the form of a cable 66 which is connected between spreader member 50 and cover 16 on the cover pivot side of the centre of gravity, as shown. Cable 66 not only maintains the container in an upright position, it also maintains cover 16 in a closed position. Since cable 66 is under constant tension by the weight of the container, there is a constant cover closing force applied to the cover. Any cover opening force applied to the cover will tend to increase the tension in cable 66 and, hence, increase the cover closing force. In order to open the cover, it is necessary to remove the tension on cable 66 and this is readily accomplished by pivoting the container forwardly slightly, i.e. in a counterclockwise direction as viewed in FIG. 2.

Figure 4:
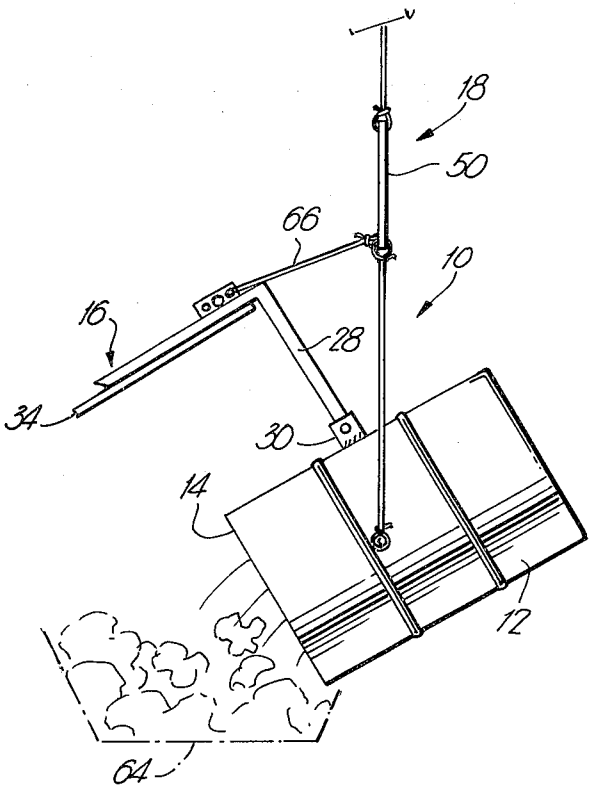
FIGS. 3 and 4 are views similar to FIG. 2 but illustrating the manner in which the container is emptied.
Figure 3:
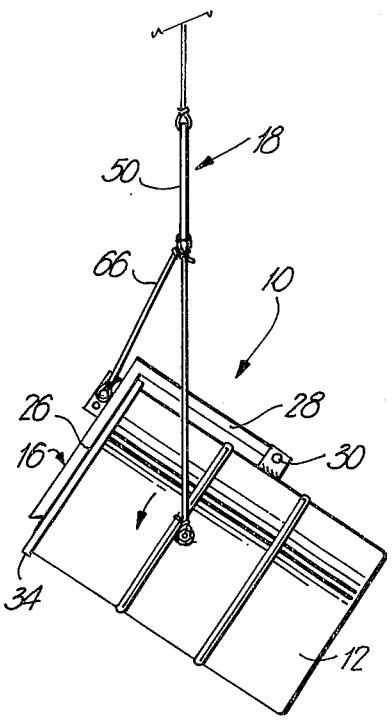

When it is desired to empty the container, a counterclockwise torque is applied to the container so as to pivot the container to the positions shown in FIGS. 3 and 4. As shown in FIG. 3, the container and cover have been moved to a position where cable 66 has become tensioned in a cover opening direction. In FIG. 4, the cover is held in position away from opening 14 as the contents of the container are discharged into a refuse receiving bucket of a refuse collection vehicle 64.

It will be seen then that the present device is not only not readily destroyed by animals, the cover is maintained securely closed and yet is easily opened while discharging the container. Further, the suspending cables support the weight of the container and contents and therefore the only force that need to be applied to the container when discharging it is the pivoting torque discussed earlier. Thus, the container can be readily emptied by one person. While it may seem that animals may be able to pivot the container to the discharging position, this has not been found to be the case. Rather, it has been found that animals tend to apply either horizontal or downward forces to the container and such forces are not effective to open the cover or discharge the container.

Figure 6:
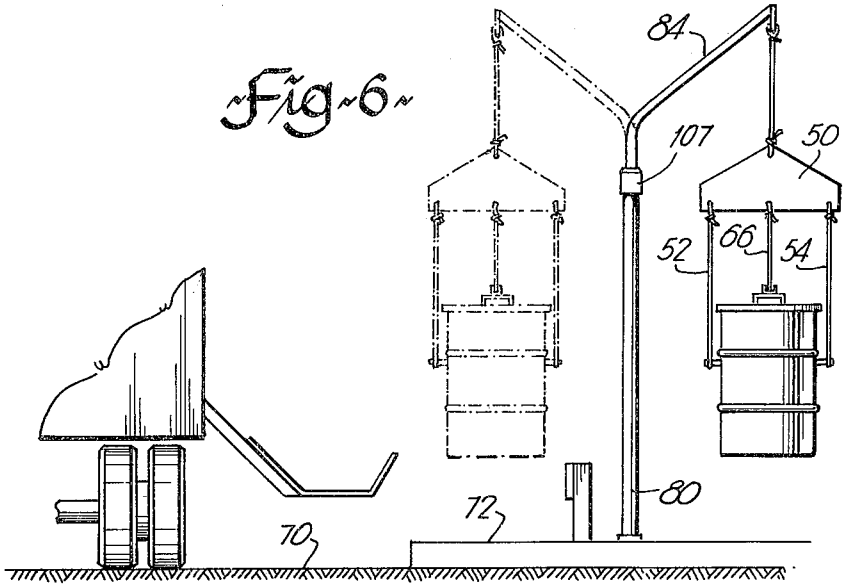
FIG. 6 is an elevational view of the container suspended from a support pole.

In a preferred form of the invention, the pole is formed in such a manner that its upper end can be rotated about a vertical axis as shown in FIG. 6, so that the container assumes a normally out-of-the-way position shown in solid lines in FIG. 6 and a discharging position shown in dotted lines. This is particularly advantageous, when the container is located near a roadway 70 having a sidewalk 72 as shown in FIG. 6.

Figure 5:
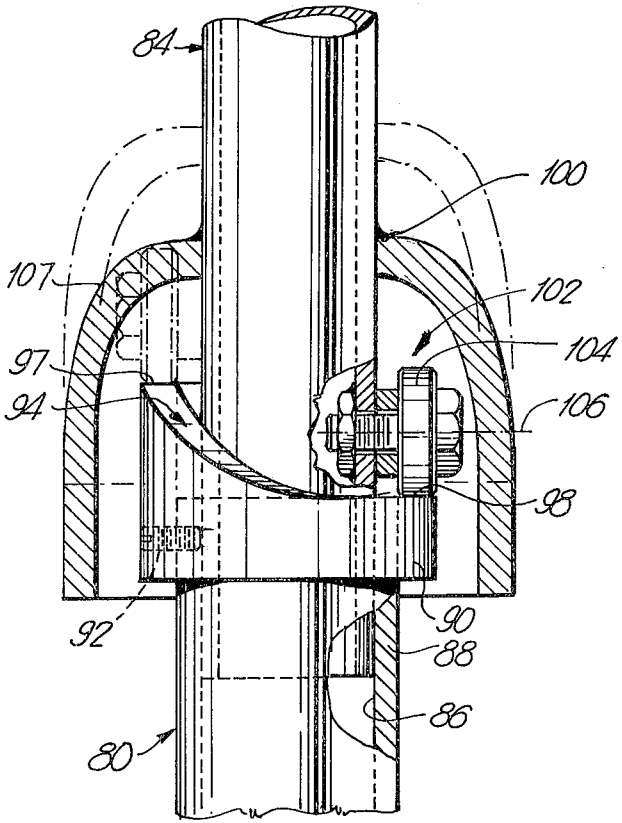
FIG. 5 is a broken view of a portion of the support column for the container.

In this form of the invention, the pole 40 is formed with a tubular lower portion 80 having its lower end 82 rigidly secured into the ground and an upper portion 84 telescopingly received in an axial bore 86 formed in upper end 88 of portion 80 as shown in FIG. 5. An annular cam member 90 is secured to end 88 of portion 80 by a set screw 92 or the like. Member 90 is formed with an annular cam surface 94 having a ridge portion 96 and a valley portion 98.

The lower end 100 of upper portion 84 is provided with a cam follower 102 which preferably takes the form of a wheel or bearing 104 rotatable about a radial axis 106 (FIG. 5). As shown wheel 104 is adapted to ride on cam surface 94. It will be understood that wheel 104 will tend to roll into valley portion 98 under the influence of gravity. A protecting cap 107 is secured to the upper portion of the pole to protect the wheel and cam from the environment. Thus, valley portion 98 defines the out-of-the-way position of the container and ridge portion 96 defines the discharge position of the container.

It will be understood that various modifications may be made to the present device without departing from the spirit of the invention defined in the appended claims. For example, except for cable 66, the resilient cables can be readily replaced by appropriate rigid, tubular members. Any suitable pole in existance at the container site may be used instead of the special pole described herein.

The embodiments of the invention in which an exclusive property or privilege is claimed are defined as follows:

1. An animal-resistant refuse container assembly, comprising:

a receptacle having an opening at one end for charging and discharging refuse into and from said receptacle, said one end defining the upper end of said receptacle;

suspension means for suspending said receptacle above ground level for free swinging movement, said receptacle being connected to said suspension means for pivotal movement about a first pivot axis, said first pivot axis extending transversely of and being laterally displaced from the longitudinal, vertical axis of said receptacle and being disposed above the centre of gravity of said receptacle whereby said receptacle is urged under its own weight for pivotal movement in one direction about said first pivot axis;

a cover for said opening, said cover being connected to said receptacle for pivotal movement about a second pivot axis between opened and closed positions, said second pivot axis being parallel to said first pivot axis and disposed on the opposite side of said longitudinal axis from said first pivot axis; and means connected between said cover and said suspension means for maintaining said receptacle in an upright position and urging said cover to said closed position but permitting, during discharging of said receptacle, said receptacle to pivot about said first axis in a direction opposite said one direction and permitting said cover to move to said opened position.

2. A refuse container assembly as defined in claim 1, said means connected between said cover and said suspension means having a line of action disposed on said opposite side beyond said second pivot axis.

3. A refuse container assembly as defined in claim 2, said suspension means including cable means having its ends connected to opposed sides of said receptacle about said first pivot axis and a mid-point connected to a support.

4. An assembly as defined in claim 3, said suspendion means comprising a first cable means connected at one end to a support means and at the other end to a rigid member, second and third spaced apart cable means connected at one end to said member and at their other ends to opposite sides of said receptacle about said first pivot axis.

5. An assembly as defined in claim 2, said means connected between said cover and said suspension means being a cable means.

6. An assembly as defined in claim 4, said support means including a pole adapted to be implanted into a supporting surface and having an upper free end, said first cable means being connected to said free end of said pole.

7. A device as defined in claim 6, said pole including:

a first elongated, substantially straight, tubular portion adapted to be rigidly secured in an upright position in a supporting surface, and having an upper end, an axial bore in said upper end and a cam member having an annular cam surface concentrically secured to said upper end, a second elongated tubular portion having a bend so as to define a first section and a second section, said first section being formed to be telescopingly received in said bore, a cam follower projecting from the periphery of said first section and engagable with the cam surface, said first section being rotatable in said bore and said cam surface and said cam follower being operable to bias said second portion in one direction, the end of said second section remote from said bend defining said free upper end.

8. A device as defined in claim 2, said receptable being cylindrical and having a circular bottom wall at its other end;

said cover being unitary, formed of a plastic material, and shaped to matingly overlie said opening, said cover further having an arm extending toward said bottom wall, disposed on the exterior of said container and pivotally connected to the side of said receptacle.

9. An animal-resistant refuse container assembly for use in parks, camp grounds and the like, comprising:

a cylindrical receptacle having an annular side wall, a circular bottom wall and an open upper end defining a refuse material charging and discharging opening;

suspension means for suspending said receptacle above ground level for free swinging movement, said receptacle being connected to said suspension means for pivotal movement about a first pivot axis, said first pivot axis extending transversely of and being laterally displaced from the longitudinal, vertical axis of said receptacle and being disposed above the centre of gravity of said receptacle whereby said receptacle is urged under its own weight for pivotal movement in one direction about said first pivot axis, said suspension means including:

a support pole having an elongated substantially straight tubular first portion adapted to be vertically implanted into the ground and having an upper free end and a second portion having one end adapted to be rotatably mounted on the free end of said first portion for movement about a vertical axis and being bent at its other end so as to horizontally displace said other end away from said first portion, said one end of said second portion being adapted to be telescopingly received within the free end of said first portion;

an annular cam member secured to said free end of said first portion and having an annular curved cam surface;

a cam follower secured to said one end of said second portion and adapted to matingly engage said annular cam surface;

said cam member and said cam follower being effective to bias said second portion in a predetermined direction relative to said first portion;

a first cable having one end secured to said other end of said second portion of said pole;

a rigid spreader member having its mid-point secured to the other end of said first cable, the length of said member being greater than the diameter of said receptacle;

second and third cables, one end of each said second and third cable means being secured to opposite ends of said member, the other end of said second and third cables being secured to said receptacle on opposite sides thereof about said first pivot axis;

a cover adapted to matingly overlie said opening and having an arm extending toward said bottom wall, parallel to said longitudinal axis, disposed on the exterior of said receptacle and connected to said side wall of said receptacle for pivotal movement about a second pivot axis between opened and closed positions, said second pivot axis being parallel to said first pivot axis and disposed on the opposite side of said longitudinal axis from said first pivot axis; and tension means connected between said cover and said suspension means for maintaining said receptacle in an upright position and urging said cover to said closed position but permitting, during charging of said receptacle, said receptacle to be pivoted about said first pivot axis in a direction opposite said one direction and said cover to move to said opened position, said tension means having a line of action disposed on said opposite side beyond said second pivot axis.

* * * * *